US005135463A

United States Patent [19]

Hyduk

[11] Patent Number: 5,135,463

[45] Date of Patent: Aug. 4, 1992

[54] BOTTOM PRESSURE PAD FOR GABLE CARTON FORMING APPARATUS

[75] Inventor: Kenneth J. Hyduk, North Olmsted, Ohio

[73] Assignee: Champion International Corporation, Stamford, Conn.

[21] Appl. No.: 667,349

[22] Filed: Mar. 11, 1991

[51] Int. Cl.[5] ..... B31B 1/28

[52] U.S. Cl. ..... 493/133; 493/143; 493/218; 493/936

[58] Field of Search ..... 493/133, 135, 141, 142, 493/143, 144, 145, 146, 218, 936

[56] References Cited

U.S. PATENT DOCUMENTS

| | | | |
|---|---|---|---|
| 3,120,335 | 2/1964 | Egleston et al. | 229/184 X |
| 3,252,386 | 5/1966 | Reimers | 493/133 |
| 3,422,730 | 1/1969 | Mitzelfelt et al. | 493/164 X |
| 3,971,300 | 7/1976 | Bachner | 493/133 |
| 4,011,800 | 3/1977 | Walke | 493/133 |
| 4,761,156 | 8/1988 | Bachner et al. | 493/133 |
| 4,838,847 | 6/1989 | Kume et al. | 493/133 |
| 5,021,040 | 6/1991 | Phillips | 493/133 |

*Primary Examiner*—Bruce M. Kisliuk
*Assistant Examiner*—John A. Mariott
*Attorney, Agent, or Firm*—Evelyn M. Sommer

[57] ABSTRACT

A pressure pad is provided for bottom sealing of a gable carton. The pressure pad cooperates with a mandrel which is urged into an opened-top gable carton for sealing the carton bottom. The pressure pad is provided with a sealing bar matrix which is disposed thereon to register with at least selected raw edges of paperboard material on the carton bottom. Each sealing bar functions to compress the fibrous paperboard material from which the carton is formed to render the raw edges less likely to absorb liquids that may be wicked from the raw edges to other locations in the carton. The carton formed by the pressure pad is characterized by reduced thickness raw edges adjacent the bottom.

8 Claims, 3 Drawing Sheets

BOTTOM PRESSURE PAD FOR GABLE CARTON FORMING APPARATUS

BACKGROUND OF THE INVENTION

Cable cartons are widely employed for beverages and other liquids. A gable carton is formed from a single blank of paperboard material with an array of score lines about which the paperboard material is folded to form the carton.

With reference to FIG. 1, a typical blank for a prior art gable carton is identified generally by the numeral 10. The prior art blank 10 includes first through fourth rectangular side wall panels 12, 14, 16 and 18 and a side glue panel 20 which are consecutively articulated to one another along parallel fold lines 13, 15, 17 and 19 respectively. The first side wall panel 12 is further defined by a raw edge of paperboard material 11 which extends parallel to the fold line 13. A first bottom fold line 21 and a first top fold line 22 extend between the raw edge 11 and the fold line 13 to further define the first side panel 12.

A first bottom panel 23 is articulated to the first side panel 12 of the prior art blank 10 along the first bottom fold line 21. The first bottom panel 23 is further defined by a side raw edge 24 which extends generally colinearly from the raw edge 11. The first bottom panel 23 is further defined by a fold line 25 which extends colinearly from the fold line 13 and by a bottom raw edge 26 which extends between the side raw edge 24 and the fold line 25. The bottom raw edge 26 typically will be disposed at an interior location on the gable carton formed from the prior art blank 10.

A first top panel 28 is articulated to the first side panel 12 along the first top fold line 22. The first top panel 28 is further defined by a side raw edge 29 which extends colinearly from the raw edge 11 and by a fold line 30 which extends colinearly from the fold line 13. A fold line 31 extends between the side raw edge 29 and the fold line 30 to further define the first top panel 28. A first top seal panel 33 is articulated to the rectangular first top panel 28 along fold line 31.

The second side panel 14 is further defined by a second bottom fold line 41 and a second top fold line 42. A second bottom panel 43 is articulated to the second side panel 14 along the second bottom fold line 41. The second bottom panel 43 is further defined by converging fold lines 44 and 45. A triangular web panel 46 is articulated to the second bottom panel 43 along the fold line 44 and is articulated to the first bottom panel 23 along the fold line 25. The triangular web panel 46 is further defined by a raw edge 47 extending between the fold lines 25 and 44. Similarly, a triangular web panel 48 is articulated to the second bottom panel 43 along fold line 45. The triangular web panel 48 is further defined by fold line 49 which extends colinearly from the fold line 15 and by raw edge 50 which extends between the fold lines 45 and 49.

A second top panel 51 is articulated to the second side panel 14 along the second top fold line 42. The second top panel 51 is further defined by converging fold lines 52 and 53. Triangular web panels 54 and 55 are articulated to the second top panel 51 along fold lines 52 and 53 respectively. The triangular web panel 54 is further articulated to the first top panel 28 along fold line 30 and is further defined by fold line 56. Similarly, the triangular web panel 55 is further defined by fold line 57 which extends colinearly from the fold line 15 and by fold line 58 which extends colinearly from the fold line 56. Top seal panels 59 and 60 are articulated to the web panels 54 and 55 respectively along the fold lines 56 and 58.

The third side panel 16 of the prior art blank 10 is further defined by a third bottom fold line 61 and a third top fold line 62. A third bottom panel 63 is articulated to the third side panel 16 along the third bottom fold line 61. The third bottom panel 63 is articulated to the bottom web panel 48 along fold line 49 and is further defined by fold line 64 which extends colinearly from the fold line 17. The third bottom panel 63 is further defined by: a side raw edge 65 extends colinearly from the fold line 49 and generally orthogonal to the raw edge 50 of the bottom web panel 48; a transverse raw edge 66 which extends orthogonally from the side raw edge 65 a major distance across the third bottom panel 63; and, diagonal raw edge 67 which extends between the bottom raw edge 66 and the fold line 64. As will be explained further below, the third bottom panel 63 defines an external wall on the gable carton erected from the prior art blank 10, and the raw edges 65–67 of the third bottom panel 63 are substantially exposed on exterior regions of the carton.

A generally rectangular third top panel 68 is articulated to the third side panel 16 along fold line 62. The third top panel 68 is articulated to the top web panel 55 along fold line 57 and is further defined by fold line 69 extending colinearly from the fold line 17 and by fold line 70 extending parallel to fold line 62 between the fold lines 57 and 69. A top seal panel 72 is articulated to the third top panel 68 along fold line 70.

The fourth side panel 18 of the prior art blank 10 is further defined by a fourth bottom fold line 73 and a fourth top fold line 74 which extend orthogonally between the fold lines 17 and 19. A fourth bottom panel 75 is articulated to the fourth side panel 18 along the fold line 73. The fourth bottom panel 75 is further defined by converging fold lines 76 and 77. A triangular bottom web panel 78 is articulated to the third bottom panel 63 along fold line 64 and is further articulated to the fourth bottom panel 75 along fold line 76. The web panel 78 is further defined by a raw edge 79 which extends from the diagonal raw edge 67 generally orthogonal to the fold line 64. Similarly, a triangular web panel 80 is articulated to the fourth bottom panel 75 along fold line 77. The web panel 80 is further defined by raw edge 81 and by fold line 82 which extends colinearly from the fold line 19.

A fourth top panel 83 is articulated to the fourth side panel 18 along fold line 74. The fourth top panel 83 is further defined by converging fold lines 84 and 85. A triangular web panel 86 is articulated to the third top panel 68 along fold line 69 and is articulated to the fourth top panel 83 along fold line 84. The web panel 86 is further defined by a fold line 87 extending substantially colinearly from the fold line 70. Similarly, a triangular web panel 88 is articulated to the fourth top panel 83 along fold line 85. The web panel 88 is further defined by fold line 89 extending colinearly from the fold line 19 and by fold line 90. Top seal panels 91 and 92 are articulated to the web panels 86 and 88 along fold lines 87 and 90 respectively.

The side glue panel 20 of the prior art blank 10 is further defined by top and bottom fold lines 93 and 94 and by a raw side edge 95. A bottom glue panel 96 is articulated to the web panel 80 along fold line 82 and to the side glue panel 20 along fold line 93. The bottom glue panel 96 is further defined by a diagonal raw edge 97 and by a side raw edge 98 which extends colinearly from the side edge 95. Similarly, a top glue panel 99 is articulated to the top web panel 88 along fold line 89 and to the side glue panel 20 along fold line 94. The top glue panel 99 is further defined by a raw side edge 100 which extends colinearly from the edge 95 of the side glue panel 20.

The prior art blank 10 is cut and scored by the paperboard manufacturer. The paperboard manufacturer also typically will fold the glue panels 20, 96 and 99 relative to the remainder of the prior art blank 10 about the colinear fold lines 19, 82 and 89 respectively. The entire prior art blank 10 will further be folded substantially in half about the colinear fold lines 15, 49 and 57. The glue panels 20, 96 and 99 then will be securely adhered to the first side panel 12, the first bottom panel 23 and the first top panel 28 respectively, such that the fold lines 19, 82 and 89 are substantially adjacent the raw edges 11, 24 and 29 respectively. In this folded condition, the glue panels 20, 96 and 99 will be adhered to sides of the first side panel 12, the first bottom panel 23 and the first top panel 28 that will define the interior of the carton erected from the prior art blank 10. It will be appreciated that in the condition described above, the folded blank will be substantially flat with the first side panel 12 being in substantially face-to-face relationship with the fourth side panel 18 and with the second side panel 14 being in substantially face-to-face relationship with the third side panel 16. The folded prior art blank 10 then typically will be shipped from the paperboard manufacturer to the dairy or producer of some other liquid to be stored in the container formed from the prior art blank 10.

The dairy or other such producer of liquid to be stored in the container formed from the prior art blank 10 will have equipment for forming and sealing the gable carton. The equipment will be operative to form the collapsed prior art blank 10 into a generally tubular open ended structure. The bottom end of the tubular structure is closed by rotating the second and fourth bottom panels 43 and 75 inwardly about the second and fourth bottom fold lines 41 and 73 respectively. The first and third bottom panels 23 and 63 will then be rotated inwardly about the first and third bottom fold lines 21 and 61 respectively. This latter folding is carried out such that the first bottom panel 23 leads the third bottom panel 63. Thus, the bottom raw edge 26 of the first bottom panel 23 will be disposed interiorly relative to the third bottom panel 63. However, the side raw edge 24 of the first side panel 23 will be substantially exposed along a bottom edge of the gable carton formed from the prior art blank 10 as shown in FIG. 2. Similarly, the raw edges 65–67 of the third bottom panel 63 will be exposed in a position extending substantially centrally across the bottom of the gable carton formed from the prior art blank 10. The folded bottom panels 23, 43, 63 and 75 are adhered in overlapping relationship to one another by an appropriate hot melt. This step of the gable carton forming process is carried out by placing the folded bottom of the carton on a pressure pad, and by urging a mandrel downwardly into the open topped gable carton structure. The sealing of the bottom of the carton is achieved by appropriate application of heat and pressure by the prior art pressure pad and prior art mandrel. Effective sealing of the carton bottom may be enhanced by providing short linear embossments on the pressure pad. These prior art embossments are disposed to orthogonally intersect certain fold lines on the bottom of the panel. Additionally, the embossments may be disposed at locations on the third bottom panel that are in register with edge regions of panels located interiorly of the third bottom panel. These short discontinuous embossments are to provide a more secure sealing at selected locations on the bottom of the panel.

At this stage in the assembly and production process, the prior art paperboard blank 10 is formed into an open-topped sealedbottom carton. The open-topped carton is advanced to a filling location where milk or other such liquid is deposited into the carton. The carton is then advanced to a top sealing station where the second and fourth top panels 51 and 83 are rotated toward one another and where the first and third top panels 28 and 68 are then rotated toward one another to close the top of the carton. The various top panels are then sealed by application of appropriate heat and pressure to the seal panels 33, 59, 60, 72, 91 and 92.

The paperboard material from which the prior art blank 10 is formed is a fibrous material having a natural tendency to absorb liquids. The opposed faces of the prior art blank 10 typically will be coated with a plastic or foil to render these faces substantially impermeable. However, edge regions of the prior art blank 10 are capable of absorbing liquid, and function as wicks which enable the liquids to travel from one location in the paperboard material to another location. Absorption of liquids and wicking from edge regions of the glue panels disposed interiorly on the carton can be prevented by skiving away all or a major portion of the paperboard material along the raw edge but leaving the coating or foil. The remaining coating or foil can then be folded over the raw edge of the remaining paperboard material to effectively seal this interiorly disposed edge and prevent absorption and wicking. This teaching is shown in U.S. Pat No. 4,802,620 which issued to Robert Phillips on Feb. 7. 1989 and which is assigned to the Assignee of the subject invention. The disclosure of U.S. Pat. No. 4,802,620 is incorporated herein by reference.

Gable cartons filled with milk or other beverages often will be transported along conveyors and may be stored in trucks or coolers where liquids may accumulate. Thus, external raw edges, particularly near the bottom of the prior art gable carton are likely to absorb and wick lubricants or other fluids with which the carton may come in contact. The filled gable cartons may be stored for many days, thus allowing ample time for such extraneous liquids to wick through the paperboard material and cause discoloration of the carton or contamination of liquids stored therein Furthermore, the wicking of liquids into the paperboard material defining the bottom of the carton can affect the structural integrity of the prior art gable carton, thereby causing leakage of the material stored in the carton.

In view of the above, it is an object of the subject invention to provide apparatus for forming a gable carton bottom with a substantially reduced tendency to absorb liquids.

Another object of the subject invention is to provide a pressure pad for sealing the bottom of a gable carton to substantially eliminate absorption and wicking of liquids through the bottom of the carton.

A further object of the subject invention is to provide a gable carton having a bottom formed to prevent or minimize absorption and wicking of fluids along raw edges of the paperboard material from which the gable carton is formed.

SUMMARY OF THE INVENTION

The subject invention is directed to a pressure pad for use in an apparatus for sealing the bottom of a gable carton. More particularly, the pressure pad will define the surface on which the folded bottom flaps of the carton will be disposed during the bottom sealing. A mandrel will be urged downwardly through the opened top of the gable carton such that the bottom of the carton is urged between the mandrel and the pressure pad. The sealing is effected by a hot melt or other adhesive that is locally applied or coated to the bottom panels and by appropriate application of pressure and/or heat.

The pressure pad of the subject invention is provided with a sealing bar disposed at locations on the pressure pad that will register with raw edges on the bottom of the carton. More particularly, the sealing bar may be registered with the bottom and diagonal edges of the third bottom flap of the prior art blank described and illustrated above on cartons where the third bottom panel will comprise the outer flap of the gable carton. The sealing bar may alternatively or additionally be disposed to register with the side raw edge of the first bottom panel of the prior art blank described and illustrated above. As noted above, the side edge of the first bottom panel will be disposed adjacent a bottom side edge of the gable carton.

The sealing bar preferably is dimensioned to compress the fibrous paperboard material adjacent the raw edges to substantially prevent absorption and wicking of liquids. Precise dimensions of the sealing bar may vary depending upon characteristics of the paperboard for a particular application. In a typical embodiment, the sealing bar may define a thickness of approximately 0.010 inch and a width of approximately 3/16 inch. The sealing bar may be interrupted at locations aligning with one of the triangular bottom panels of the carton.

The carton formed with the pressure pad having the above described sealing bar will have raw edges that are compressed and define thinner dimensions than the paperboard material adjacent thereto. Thus, the compressed raw edges will be less likely to absorb lubricants or other stray liquids and will prevent wicking of such liquids into the paperboard material of the carton.

DETAILED DESCRIPTION OF THE PREFERRED EMBODIMENTS

Figure 3:
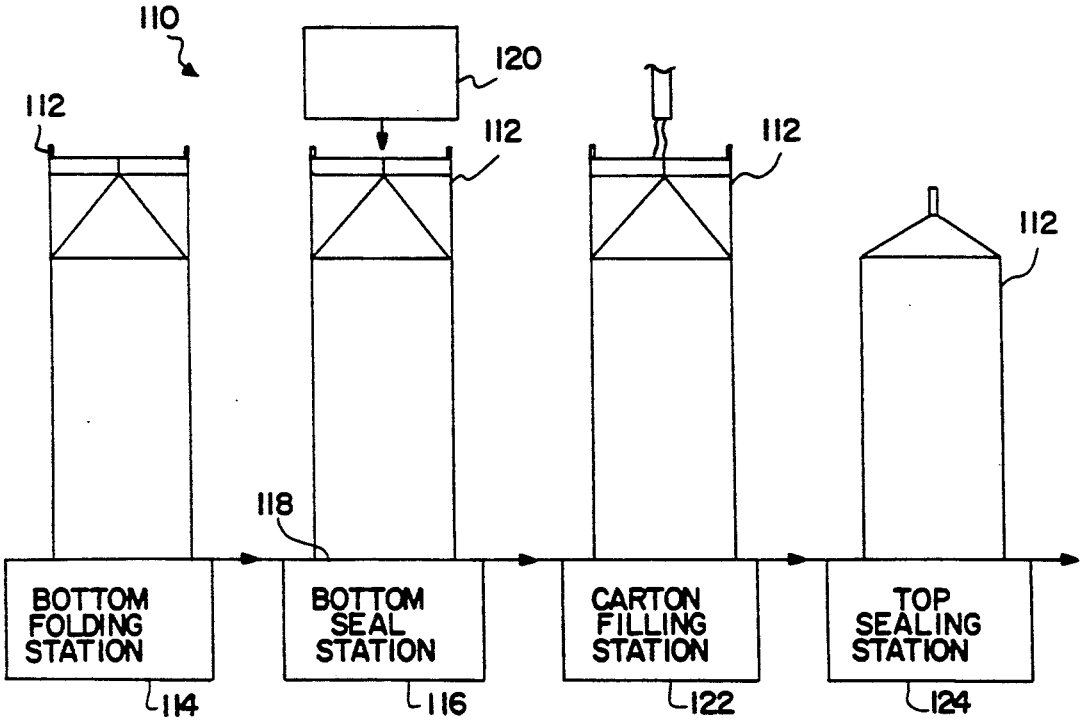
FIG. 3 is a schematic diagram showing stations at a dairy for forming and filling a carton from a paperboard blank.

A gable carton forming apparatus in accordance with the subject invention is illustrated schematically in FIG. 3 and is identified generally by the numeral 110. The apparatus 110 is operative to form, fill and seal a gable carton 112 from a prior art blank 10 as illustrated above. More particularly, the apparatus 110 comprises a plurality of stations which are illustrated schematically in FIG. 3. The first station 114 defines a bottom folding station which is operative to fold the various bottom panels of the prior art blank 10. The bottom folding station 114 of the apparatus 110 may employ prior art folding equipment. The carton 112 with the bottom panels thereof folded is advanced to a bottom sealing station illustrated schematically in FIG. 3 and identified generally by the numeral 116. The bottom sealing station 116 includes a pressure pad 118 on which the open-topped gable carton 112 is disposed. The bottom sealing station 116 further comprises a mandrel 120 which is selectively movable toward and away from the pressure pad 118 and into the open-topped gable carton 112. Heat and pressure generated by the mandrel 120 and the pressure pad 118 are operative to seal the bottom of the carton 112. The construction of the pressure pad 118 is described in greater detail below.

The gable carton 112 with the sealed bottom and the opened top is advanced to the carton filling station 122 where milk or other such liquid is poured into the carton 112. The filled carton 112 is then advanced to a top sealing station 124 at which the top of the gable carton 112 is closed and sealed.

As explained above, the gable carton 112 may be passed along conveyors that are lubricated and may be stored on surfaces that can accumulate fluid. These fluids could be absorbed by the raw edges of the prior art carton and wicked through the paperboard material.

Figure 4:
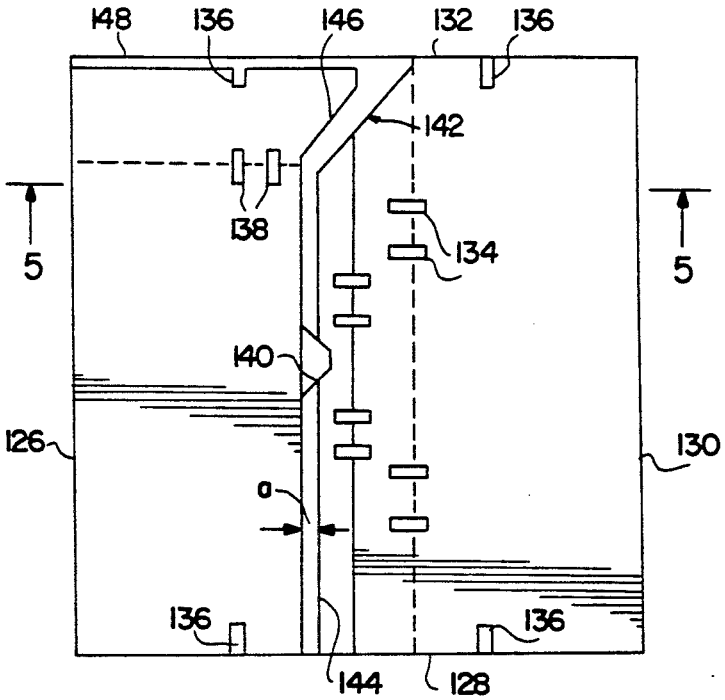
FIG. 4 is a top plan view of a pressure pad in accordance with the subject invention.

The apparatus 10 is provided with a pressure pad 118 which is operative to prevent the absorption and wicking problems described above. In particular, the pressure pad 118 is substantial square in plan view configuration as shown in FIG. 4. More particularly, the pressure pad 118 includes substantially equally dimensioned first through fourth edges 126–132 which will register respectively with the first through fourth side wall panels 12–18 on the carton erected from the prior art blank 10.

Figure 5:
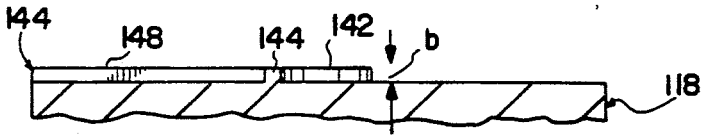
FIG. 5 is a cross-sectional view taken along line 5—5 in FIG. 4.

As shown in both FIGS. 4 and 5, the pressure pad 118 is generally planar. However, the pressure pad 118 is provided with a plurality of localized embossments for achieving a mechanical interengagement of the bottom panels to enhance the adhesive attachment. In particular, embossments 134 are disposed generally at locations where the bottom edge 26 of the first bottom panel 23 registers with the third bottom panel 63. Similarly, web panel embossments 136 are disposed adjacent the fold lines 25, 49, 64 and 82 to which the respective web panels 46, 48, 78 and 80 are connected. Furthermore, an embossment 138 is provided to register with the location where the raw edge 98 of the bottom glue panel 96 aligns with the first bottom panel 23. In addition to the short linear embossments 134–138, the pressure pad 118 is provided with a chevron embossment 140 disposed to align with a location in register with the second and fourth bottom panels 43 and 75 of the blank 10. The localized embossments 134–140 are provided to provide some mechanical interengagement between adjacent panels of the blank 10 and to ensure close face-to-face engagement of overlapping sections.

In addition to the localized embossments 134–140, the pressure pad 118 is provided with a sealing bar matrix identified generally by the numeral 142. The sealing bar matrix is disposed on locations of the pressure pad 118 which will be in register with exposed raw edges of the blank 10 seated on the pressure pad 118. In particular, the sealing bar matrix 142 comprises a transverse sealing bar 144 which is disposed to register with the transverse edge 66 of the third bottom panel 63 on the blank 10. The sealing bar matrix 142 further includes a diagonal sealing bar 146 disposed to register with the diagonal raw edge 67 on the third bottom panel 63. Still further, the sealing bar matrix 142 includes a side sealing bar 148 disposed to register with the side raw edge 24 of the first bottom panel 23. The sealing bar matrix 142 functions to compress or crush localized regions of the fibrous material which comprises the paperboard blank 10. As a result, the localized regions of the paperboard material engaged by the sealing bar matrix 142 define a substantially reduced thickness and are less likely to absorb liquids which could otherwise wick to other areas of the carton. Preferably the sealing bars of the matrix 142 define a width of approximately ⅛–¼ inch as indicated by dimension "a" in FIG. 4, and most preferably a width "a" of approximately 3/16 inch. Similarly, the sealing bars of the matrix 142 preferably defines a height "b" in FIG. 5 of between 0.005–0.020 inch, and most preferably a height "b" of approximately 0.010 inch. The sealing bar matrix 142 of the indicated dimensions may be separately applied to an existing pressure pad 118 or may be machined directly into a metallic stock material for defining the pressure pad 118.

Figure 1:
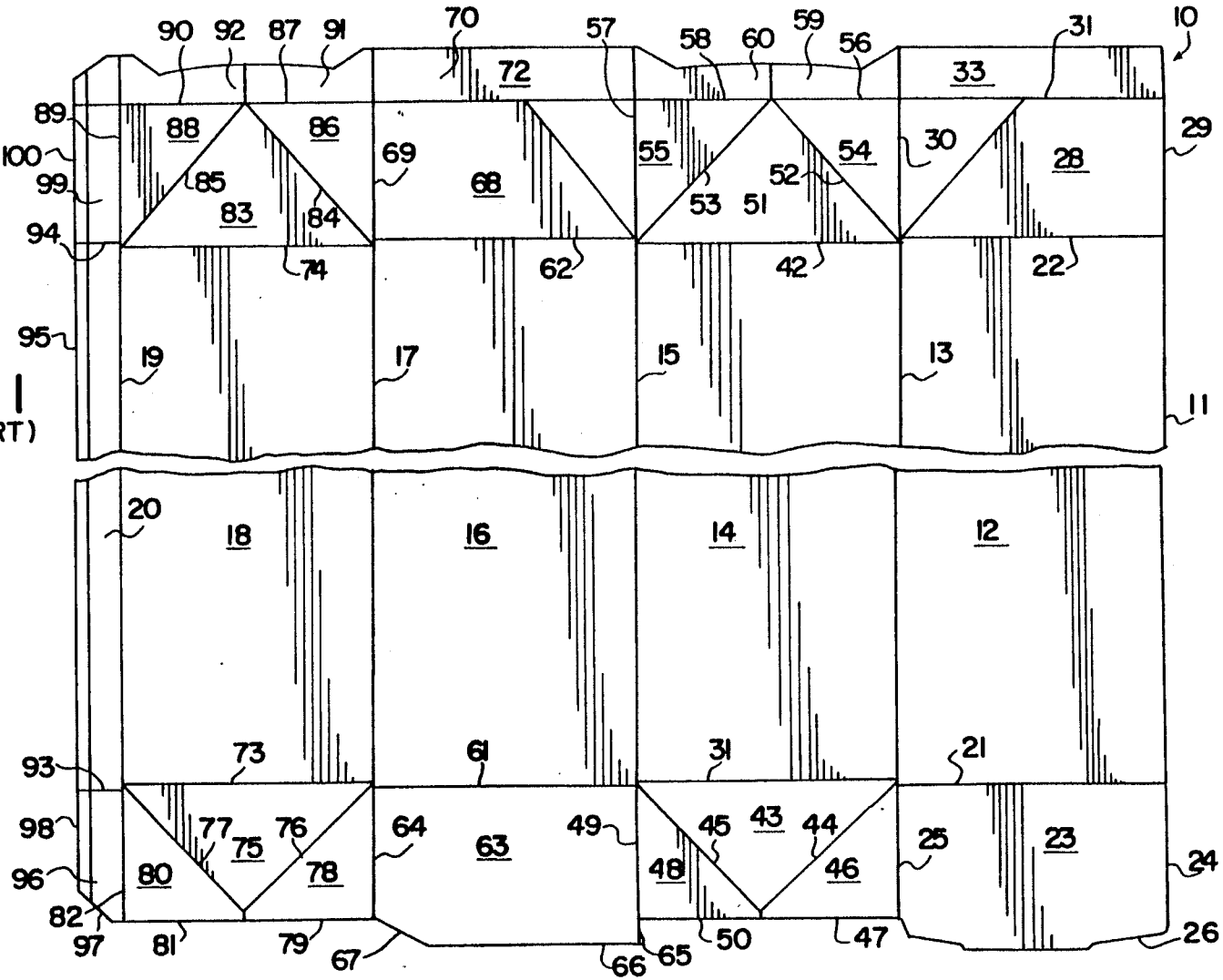
FIG. 1 (PRIOR ART)
FIG. 1 is a top plan view of a prior art blank for forming a gable carton.
Figure 2:
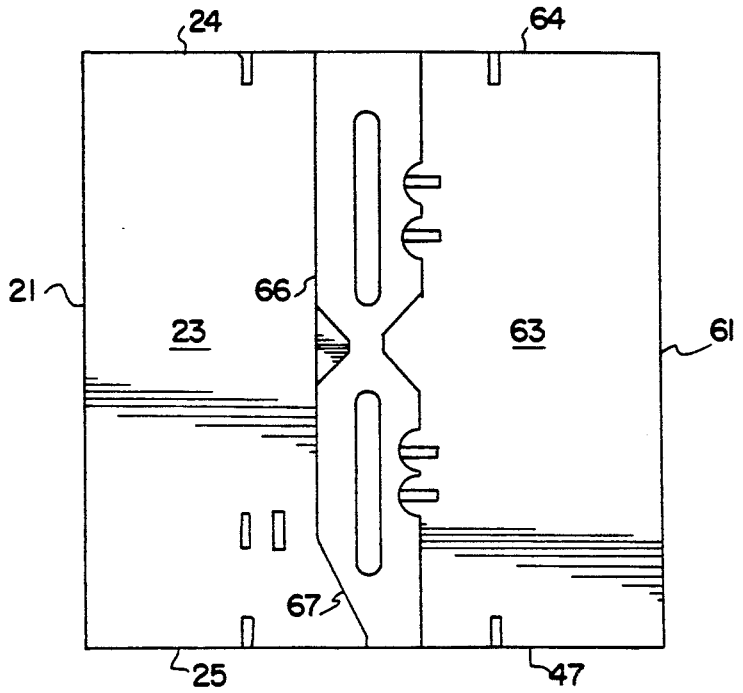
FIG. 2 is a bottom plan view of a prior art gable carton formed from the blank of FIG. 1.

The carton formed with the pressure pad 118 will be similar in configuration to the prior art carton depicted in FIG. 2 above. However, the exposed raw edges 24, 66 and 67 will define a reduced thickness that is less susceptible to absorption and wicking of fluids.

Figure 6:
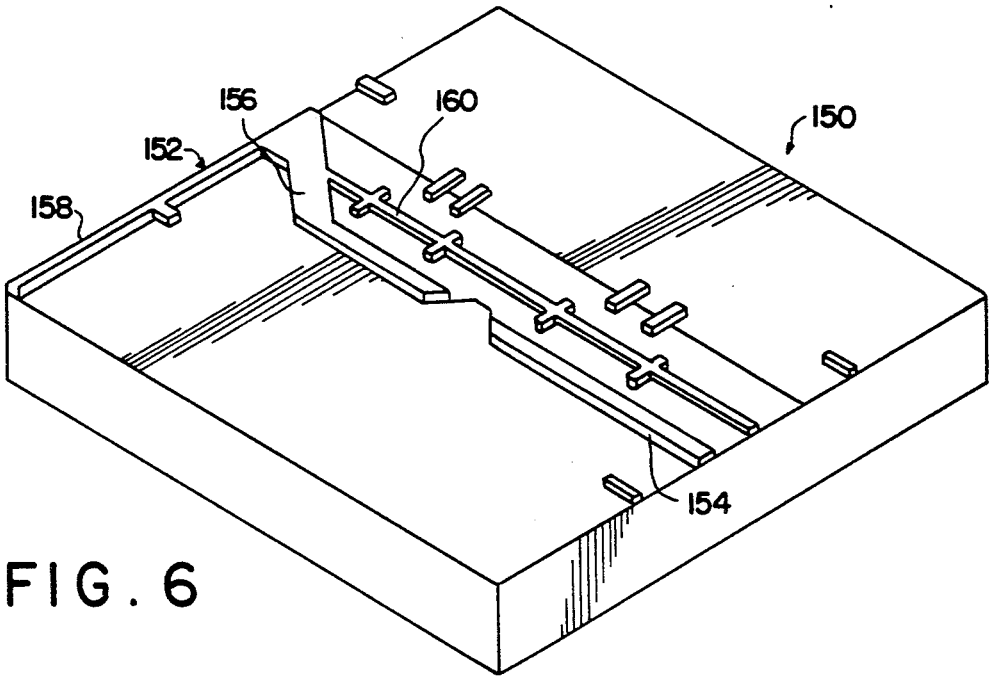
FIG. 6 is a perspective view of an alternate embodiment of a pressure pad in accordance with the subject invention.

The precise configuration of the sealing bar depicted in FIG. 4 may be varied in accordance with the specific configuration of the bottom panels on the gable carton. An alternate pressure pad 150 is depicted in FIG. 6 and shows a sealing bar matrix identified generally by the numeral 152. It will be noted that the sealing bar matrix 152 in FIG. 6 includes a transverse sealing bar 154, a diagonal sealing bar 156 and a side sealing bar 158. Additionally, a sealing bar 160 extending generally parallel to the transverse sealing bar is provided for compressing internally disposed edge regions of the first bottom panel 23.

In summary, a pressure pad is provided for the bottom sealing of a gable carton. The pressure pad is characterized by a sealing bar matrix disposed on the pressure pad to register with selected raw edges of the paperboard material from which the gable carton is formed. Preferably the sealing bar will register with at least the exposed raw edges on exterior regions of the gable carton. The sealing bar matrix will function to compress the fibrous paperboard material of the blank from which the gable carton is formed, and to thereby render the raw edges less susceptible to absorption and wicking of liquids to which the carton bottom may be exposed.

While the invention has been described with respect to certain preferred embodiments, it is apparent that various changes can be made without departing from the scope of the invention as defined by the appended claims. In particular, the exact configuration of the sealing bar matrix may be varied from the illustrated configurations to conform to the disposition and alignment of raw edges on the bottom of the particular gable carton. The relative dimensions of the sealing bar may also vary in accordance with characteristics of the paperboard material from which the gable carton is formed. These and other changes may be apparent to a person skilled in the art after having read applicant's disclosure.

I claim:

1. A pressure pad for sealing a bottom of a carton, the carton being formed form a paperboard material and the bottom being defined by a plurality of bottom panels disposed in at least partly overlapping relationship to one another, each said bottom panel including at least one raw edge of paperboard material having a given thickness, at least one said bottom panel being disposed such that the raw edge thereof is externally exposed, the pressure pad defining a generally planar surface having at least one sealing bar extending therefrom, the at least one sealing bar being disposed on the pressure pad and having a length and width to generally register only with substantially the entire externally exposed raw edge of the at least one said bottom panel of the carton for compressing the paperboard material adjacent to substantially the entire externally exposed raw edge to a thickness substantially reduced from said given thickness, whereby substantially the entire externally exposed raw edge engaged by the at least one sealing bar is rendered less likely to absorb liquids, wherein the at least one sealing bar comprises a sealing bar matrix defined by a plurality of intersecting sealing bar sections including a transverse sealing bar section, a diagonal sealing bar section and a side sealing bar section disposed to register with a transverse externally exposed raw edge, a diagonal externally exposed raw edge and a side externally exposed raw edge, respectively, of the at least one said bottom panel of the carton.

2. A pressure pad as in claim 1, wherein the at least one sealing bar defines a width between approximately ⅛ inch and ¼ inch.

3. A pressure pad as in claim 2, wherein the at least one sealing bar defines a width of approximately 3/16 inch.

4. A pressure pad as in claim 1, wherein the at least one sealing bar extends from he plane of the pressure pad to a height between approximately 0.005 inch and 0.020 inch.

5. A pressure pad as in claim 4, wherein the at least one sealing bar defines a height of approximately 0.010 inch.

6. A pressure pad as in claim 1, wherein the surface of the pressure pad is machined such that the at least one sealing bar is unitary with the pressure pad.

7. A pressure pad as in claim 1, wherein the at least one sealing bar is applied to the generally planar surface of the pressure pad.

8. A pressure pad as in claim 1, wherein the bottom of the carton is substantially square and is defined by opposing pairs of side edges, the bottom of the carton further being characterized by the transverse externally exposed raw edge having a given thickness extending from a first side of the bottom to a location in proximity to the opposed side, the diagonal externally exposed raw edge having said given thickness extending from the transverse edge to a side of the carton bottom and the side externally exposed raw edge having said given thickness extending from the diagonal edge along one side of the carton bottom, whereby said given thickness of each of said externally exposed raw edge is substantially reduced by the plurality of sealing bar sections to render them less likely to absorb liquid.

* * * * *